US007849558B2

(12) United States Patent
Ivarsson et al.

(10) Patent No.: US 7,849,558 B2
(45) Date of Patent: Dec. 14, 2010

(54) HEAD FOR A SUCTION CLEANER

(76) Inventors: Bengt Ivar Anders Ivarsson, Flat F, 23/F, Block 20, Park Island, Ma Wan (HK); Reuben Proud, 52, Gillam Street, Worcester, WR3 8JT (GB)

( * ) Notice: Subject to any disclaimer, the term of this patent is extended or adjusted under 35 U.S.C. 154(b) by 1375 days.

(21) Appl. No.: 11/329,194

(22) Filed: Jan. 10, 2006

(65) Prior Publication Data

US 2006/0150365 A1 Jul. 13, 2006

(30) Foreign Application Priority Data

Jan. 12, 2005 (GB) ..... 0500565.7

(51) Int. Cl.
*A47L 5/00* (2006.01)

(52) U.S. Cl. ..... 15/355; 15/387; 15/389; 15/391; 15/392

(58) Field of Classification Search ..... 15/355, 15/387, 389, 391, 392; *A47L 5/00*
See application file for complete search history.

(56) References Cited

U.S. PATENT DOCUMENTS

| | | | |
|---|---|---|---|
| 2,381,710 | A | 8/1945 | Arnhym |
| 4,219,902 | A | 9/1980 | Demaagd |
| 4,355,436 | A | 10/1982 | Hertzberg et al. |
| 4,854,006 | A | 8/1989 | Nishimura et al. |
| 5,078,761 | A | 1/1992 | Dyson |
| 5,125,127 | A | 6/1992 | Bach et al. |
| 5,135,552 | A | 8/1992 | Weistra |
| 5,297,312 | A | 3/1994 | Zuiderveen et al. |
| 5,351,362 | A | 10/1994 | Kramer et al. |
| 5,500,979 | A | 3/1996 | Wörwag |
| 5,960,514 | A | 10/1999 | Miller et al. |
| 6,058,559 | A | 5/2000 | Yoshimi et al. |
| 6,286,181 | B1 | 9/2001 | Kasper et al. |
| 6,350,292 | B1 | 2/2002 | Lee et al. |
| 6,572,668 | B1 | 6/2003 | An et al. |
| 6,662,403 | B2 | 12/2003 | Oh |
| 2001/0009049 | A1 | 7/2001 | Kasper et al. |
| 2001/0011404 | A1 | 8/2001 | Roschi |
| 2002/0011053 | A1 | 1/2002 | Oh |

(Continued)

FOREIGN PATENT DOCUMENTS

DE 37 42 785 A1 6/1989

(Continued)

OTHER PUBLICATIONS

Pending U.S. Appl. No. 11/187,414, filed Jul. 22, 2005, 23 pages.

(Continued)

*Primary Examiner*—David A Redding
(74) *Attorney, Agent, or Firm*—Michael Best & Friedrich LLP

(57) ABSTRACT

A cleaning head for a suction cleaner, the head including a body; a rotatable tool connected to the body by support means; driving means; and transmission means providing a driving connection between the driving means and the tool; wherein the support means contains the transmission means, and provides for movement of the tool upwardly and downwardly relative to the body in use.

12 Claims, 5 Drawing Sheets

U.S. PATENT DOCUMENTS

| | | | | |
|---|---|---|---|---|
| 2002/0062632 | A1 | 5/2002 | Oh | |
| 2002/0088078 | A1 | 7/2002 | Oh et al. | |
| 2002/0120998 | A1 | 9/2002 | Dubos et al. | |
| 2002/0124538 | A1 | 9/2002 | Oh et al. | |
| 2003/0106182 | A1 | 6/2003 | Lee | |
| 2003/0106183 | A1 | 6/2003 | Frederick et al. | |
| 2006/0179604 | A1 * | 8/2006 | Boddy et al. | 15/377 |

FOREIGN PATENT DOCUMENTS

| | | | |
|---|---|---|---|
| DE | 38 34 686 | C1 | 12/1989 |
| DE | 94 20 797.6 | U1 | 7/1995 |
| DE | 299 00 460 | U1 | 8/2000 |
| DE | 199 14 574 | C1 | 11/2000 |
| DE | 101 10 771 | A1 | 9/2002 |
| EP | 1 386 573 | A2 | 2/2004 |
| EP | 1 396 222 | A | 3/2004 |
| FR | 2 425 227 | | 12/1979 |
| GB | 2 128 075 | A | 4/1984 |
| GB | 2 367 510 | A | 4/2002 |
| WO | WO 98/35602 | A1 | 8/1998 |
| WO | WO 2004/049887 | A1 | 6/2004 |
| WO | WO 2004/049889 | | 6/2004 |
| WO | WO 2004/049890 | A1 | 6/2004 |
| WO | WO 2004/052166 | A1 | 6/2004 |

OTHER PUBLICATIONS

Pending U.S. Appl. No. 11/217,584, filed Aug. 31, 2005, 17 pages.
Pending U.S. Appl. No. 29/240,051, filed Oct. 7, 2005, 6 pages.
Pending U.S. Appl. No. 29/240,115, filed Oct. 7, 2005, 6 pages.
Pending U.S. Appl. No. 29/240,116, filed Oct. 7, 2005, 5 pages.
Pending U.S. Appl. No. 29/240,117, filed Oct. 7, 2005, 7 pages.
Pending U.S. Appl. No. 29/240,118, filed Oct. 7, 2005, 7 pages.
Pending U.S. Appl. No. 10/537,537, filed Nov. 10, 2005, 21 pages.
Pending U.S. Appl. No. 10/537,381, filed Nov. 14, 2005, 25 pages.
Pending U.S. Appl. No. 10/537,382, filed Nov. 14, 2005, 33 pages.
Pending U.S. Appl. No. 10/537,481, filed Nov. 14, 2005, 14 pages.
Pending U.S. Appl. No. 11/273,094, filed Nov. 14, 2005, 17 pages.
Pending U.S. Appl. No. 11/375,722, filed Mar. 15, 2006, 16 pages.
U.S. Appl. No. 10/537,382, filed Nov. 2005, Boddy, et al.

* cited by examiner

HEAD FOR A SUCTION CLEANER

DESCRIPTION OF INVENTION

The invention relates to a cleaning head for a suction cleaner, and in particular to a head including a rotationally driven tool element such as a brush bar. The head may be of the kind adapted for attachment to a wand of a "cylinder" type suction cleaner, or of the kind incorporated in an "upright" type suction cleaner.

Domestic suction cleaners, more commonly called vacuum cleaners, are generally of two kinds; "upright" cleaners in which the head is connected, usually pivotably, to the main body of the cleaner, and "cylinder" cleaners in which a hose and/or wand connects any tools such as the head to the main body of the cleaner. In the former kind of cleaner the head usually includes a driven tool such as a brush and/or beater bar. In the latter kind all tools originally incorporated fixed brushes, but more recently various head designs have been introduced incorporating rotatably driven brushes.

The means of driving such brushes vary. In general in upright cleaners the brush bar is driven by a belt powered by an electric motor, this being either the main motor which provides the suction or a secondary motor provided specifically for that purpose. In cylinder cleaners, some use the suction of the main vacuum cleaner and an airflow-driven turbine in the head to drive the brush, whilst others include an electric motor in the head powered by an electrical supply provided down the hose/wand combination. The drive to the brush in the head may be by means of a belt or direct.

One particular problem associated with driven brushes is that the brush often gets entangled with elongate items which have been vacuumed up, such as pieces of string or ribbon, or even long human or animal hair. This can result in significantly degraded performance because of restricted airflow around the brush and tangling of string, ribbon or long hair around the moving parts, such as the belt, which can cause the brush to be jammed.

According to a first aspect of the present invention there is provided a cleaning head for a suction cleaner, the head including:

a body;

a rotatable tool connected to the body by support means;

driving means; and transmission means providing a driving connection between the driving means and the tool;

wherein the support means contains the transmission means, and provides for movement of the tool upwardly and downwardly relative to the body in use.

The support means may be pivotally connected to the body, with the tool spaced from the pivoted connection so as to be moveable arcuately relative to the body.

Thus, when the tool contacts a floor surface it can move relative to the body, thereby reducing friction at the interface of the tool and floor surface. On a carpet surface, for example, it can move depending on the depth of the pile of the carpet. This is particularly beneficial when the driving means is a turbine. As the torque transferred to the tool by turbine is significantly less than that by an electric motor, too much friction at the interface between the tool and a carpet surface could cause the tool to stop rotating, which is undesirable.

By containing the transmission means within the support means the likelihood of elongate items tangling in the moving parts of the head is reduced. Thus the tool is less likely to become jammed and inoperable.

The support means may include two support members spaced from one another along the tool, thereby providing increased support for the tool.

Each support member may be pivotally connected at its one end to the body and connected at its opposite end to the tool.

The transmission means may be provided in one or both support members. In the case of the transmission means provided in only one of the support members, the other support member may be devoid of any working transmission parts. The support members may be identical components, thereby reducing manufacturing costs.

The transmission means may include a flexible driving element, a first pulley driven by the driving means and a second pulley connected to the tool, with the flexible driving element entrained around the first and second pulleys and engaged therewith. In this way when the driving means drives the first pulley, the flexible driving element is caused to advance therearound, which in turn effects driving of the second pulley.

Alternatively the transmission means may include a first gear driven by the driving means and a second gear connected to the tool, the first and second gears engaging each other (possibly with one or some intermediate gears) so that drive can be transmitted from the first gear to the second gear.

The first and second pulleys and first and second gears may each be supported within the support means by respective bearing means.

The driving means may be positioned between the ends of the support members which are connected to the body.

The driving means may be an electric motor or a turbine. The turbine may be caused to rotate by an airflow travelling in a direction towards an interior of the suction cleaner, when the head is connected thereto or mounted thereon.

An axis of rotation of the turbine or motor and an axis about which both support members are connected to the body may be coaxial.

According to a second aspect of the present invention there is provided a head for a suction cleaner, the head including:

a body;

a rotatable tool connected to the body by support means;

driving means; and transmission means providing a driving connection between the driving means and the tool;

wherein the support means includes two support members spaced from opposite ends of the tool and from one another along the tool.

By supporting the tool between opposite ends thereof, and not at opposite ends thereof, the ends of the tool can be positioned very near to corresponding side walls of the head. This means that the ends of the tool can provide useful cleaning for substantially all of the width of the head, except for the thickness of the side walls. Thus so called "edge cleaning" is maximised.

The tool may include three parts; a central part and two outer parts, the central part being positioned between the support members and the outer parts being positioned on opposite outer sides of the support members.

The central part and two outer parts may be supported on an axle, which axle is supported by bearing means provided in at least one of the support members. Each part may have an aperture to receive the axle.

A surface of the axle and a corresponding surface of each aperture may have a non-circular part, e.g. a flattened portion. Thus when the parts are supported of the axle they are not able to rotate relative to the axle.

The central part and two outer parts may be releasably connected to the axle, thereby facilitating easier cleaning, maintenance or repair of the parts.

An end of each outer part, which end abuts the support member, may have a flange, and a corresponding part of the support member may have a recess to receive the flange, with the flange being able to rotate within the recess.

Each end of the central part may also be provided with a flange, and a corresponding part of each support may also be provided with a recess to receive the flange, with each flange being able to rotate within the corresponding recess.

In this way string, ribbon, long hair, or the like are less likely to become entangled around the axle. There would have to be a substantial build-up of material around each part before any of the material could find its way into any gap between an outer edge of the flange and an inner edge of the recess.

The ability of the tool to be readily removed without the use of any further tools or implements means that, in addition to the advantage of easy clearing of any entanglement from the tool, a particular type of tool may, if required, be replaced by an alternative type of tool intended to perform a different function. For example a brush bar intended for use on a carpeted surface may be replaced by a different type of brush bar intended for use on a hard surface, or by a buffing or polishing tool for example.

Thus, there may be provided a plurality of tools, adapted to perform different functions, any one of which may be installed in the head as desired.

The head may include an openable cover which when opened exposes substantially all of the tool.

The cover may be completely removable from the body.

In this way access to the tool for cleaning, maintenance or repair is easier. In fact, the tool can be accessed from above, below and in front, and substantially from the rear.

A part of the cover may be transparent or translucent, thus allowing a user to observe the working parts of the head and locate any blockages caused by foreign objects, such as, for examples, string, ribbon or long hair.

If the driving means is a turbine, the body may include a turbine chamber surrounding the turbine. The turbine chamber may be provided with a first opening connectable to a source of suction and a second opening adjacent the tool, such that, in use, the source of suction effects an airflow through the second opening, the turbine chamber and the first opening, towards the source of suction.

A lower part of the turbine chamber may be afforded by a formation in the body and an upper part of the turbine chamber may be provided by a removable part.

The removable part of the turbine chamber may be provided with a third opening, which third opening is closed when the openable cover is attached to the body. The part of the cover which closes the third opening may be provided with sealing means to seal the third opening.

The transparent or translucent part of the openable cover may be positioned above the third opening of the turbine chamber, thus allowing a user to see whether any foreign bodies are trapped within the turbine chamber.

The cover may, when connected to the body, cover the tool and the working parts of the head, with only an elongate opening being provided at a lower surface of the head to allow the tool to protrude therethrough and engage a floor surface.

The housing or removable cover may be provided with a bleed aperture. Thus if the elongate opening becomes blocked, the source of suction can still effect an airflow path through the turbine chamber.

An embodiment of the invention will now be described, by way of example only, with reference to the accompanying drawings in which.

Figure 1:
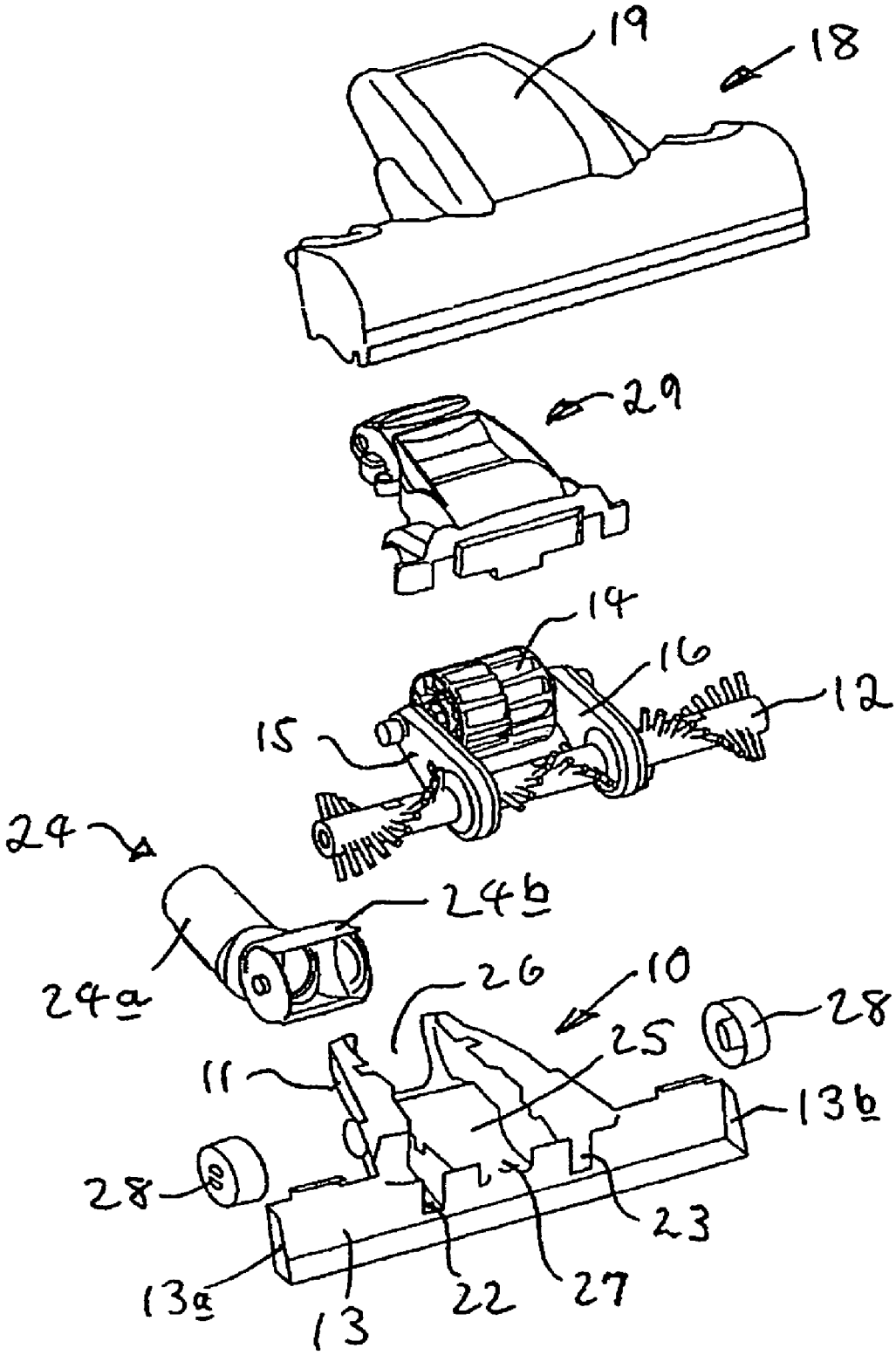
FIG. 1 is an illustrative exploded perspective view of a head in accordance with the present invention.
Figure 2:
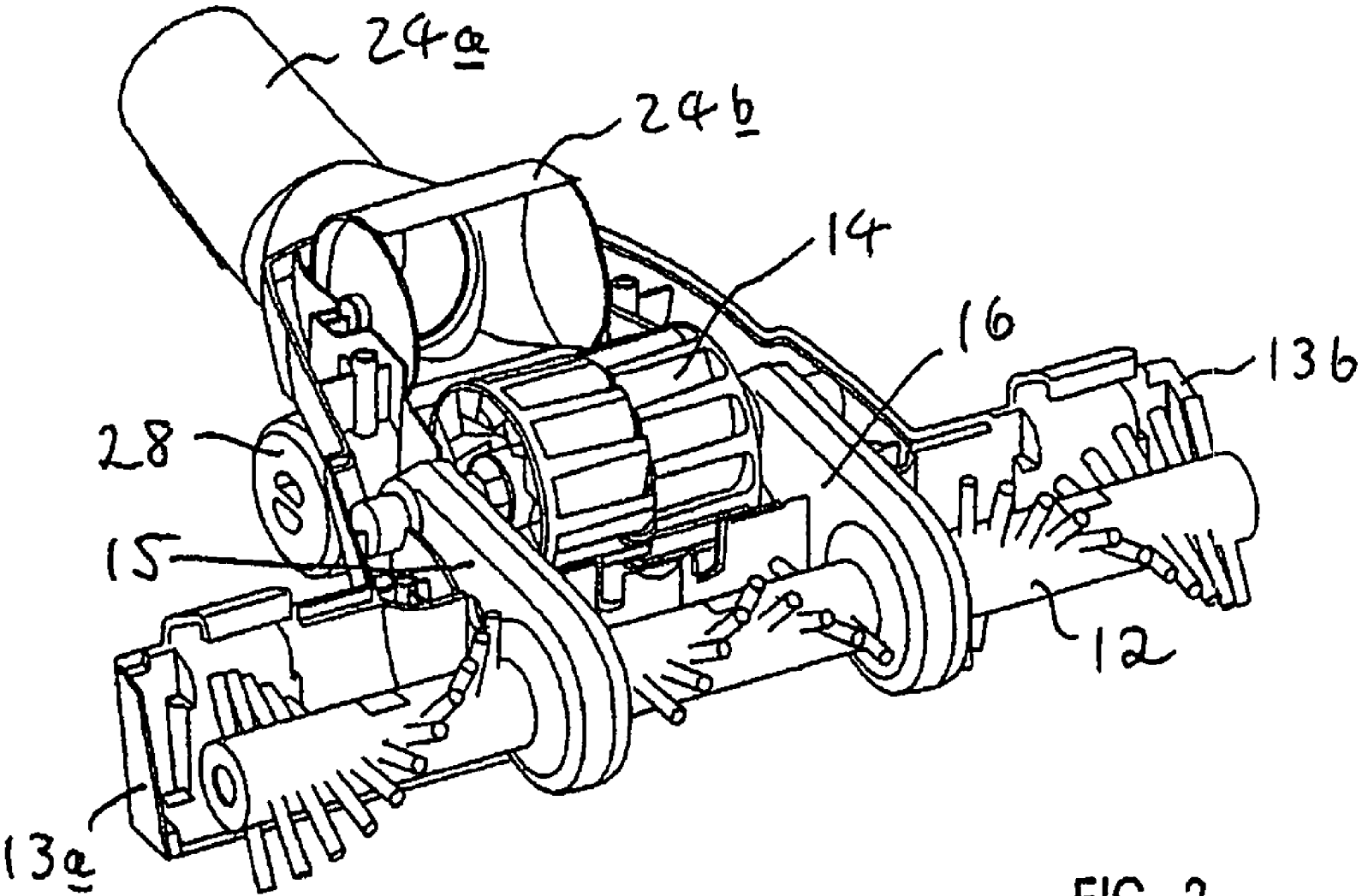
FIG. 2 is an illustrative perspective view of some of the assembled parts of the head shown in FIG. 1.
Figure 3:
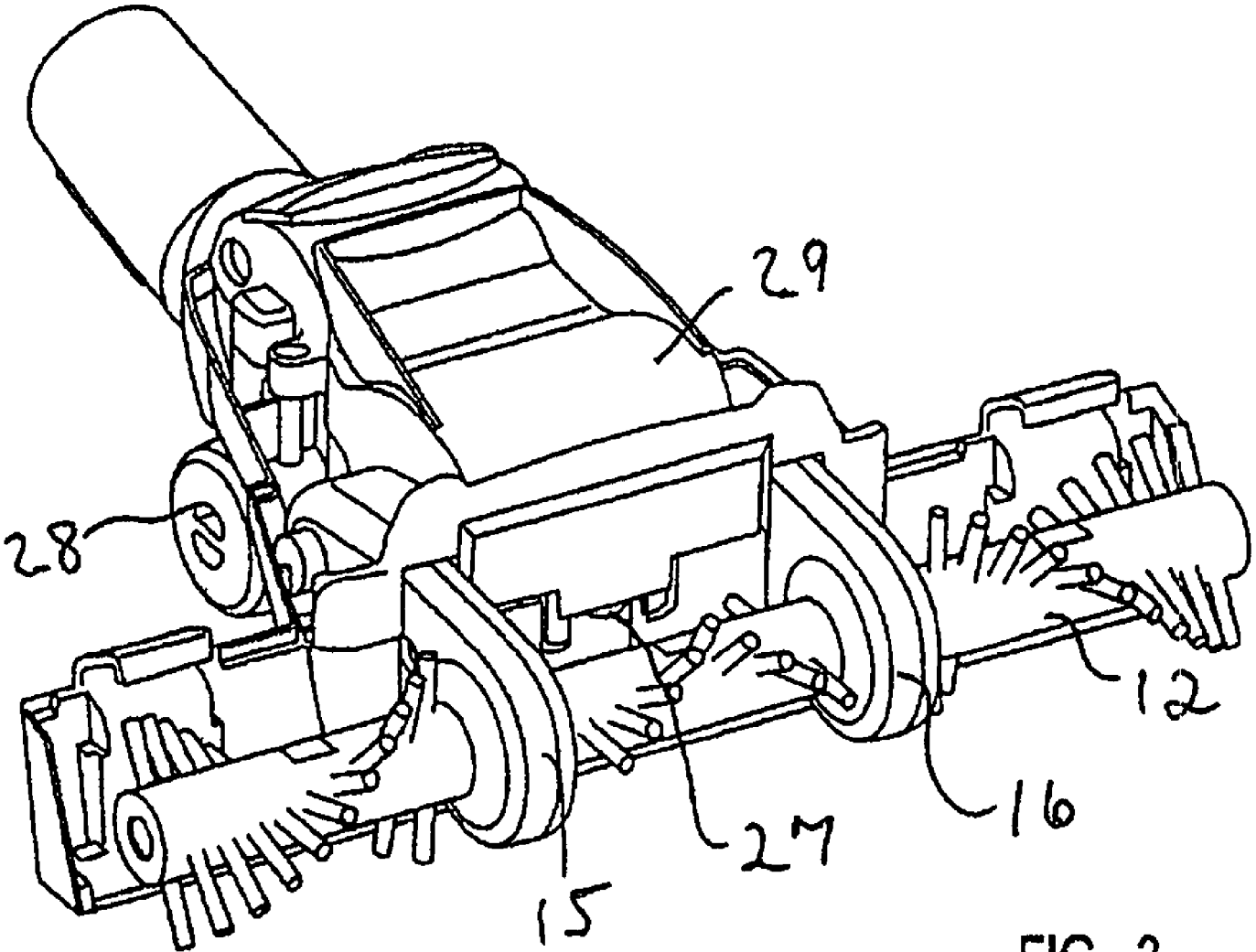
FIG. 3 is a further illustrative perspective view of some of the assembled parts of the head shown in FIG. 1.

Referring firstly to FIGS. 1 to 3, these show illustrative perspective views of a head in accordance with the present invention. The head shown is of the kind connectable to a "cylinder" suction cleaner, although it could easily be an integral part of an "upright" suction cleaner. The head has a body 10, a rotatable tool 12 connected to the body 10 by support means in the form of a pair of support members 15, 16, driving means in the form of a turbine 14 and transmission means 43 (shown in FIGS. 4 and 5) contained within the support member 15 for providing drive from the turbine 14 to the tool 12.

The body 10 of the head is substantially T-shaped when viewed from above and has a first part 11 and a transverse member 13 connected to the first part 11. The first part 11 supports the turbine 14 and one end of each support member 15,16, and has a pair of recesses 22,23 to receive the support members 15,16 respectively.

The first part 11 also provides a lower part 25 of a turbine chamber adapted to receive the turbine 14. The lower part 25 has a first opening 26 at an end thereof remote from the transverse member 13, connectable to a source of suction (not shown), and a second opening 27 substantially opposite the first opening 26 and adjacent the transverse member 13.

The transverse member 13 receives the tool 12 and has side walls 13*a,b* which extend away from the transverse member 13 substantially perpendicularly therefrom.

An upper part of the turbine chamber (whose lower part is numbered 25) is provided by a removable part 29, which is connectable to the first part 11 of the body 10 to close the turbine chamber 25.

A connector 24 has a hollow spigot 24*a*, extending from a transverse part-cylindrical portion 24*b* which lies in the opening 26, constrained to limited pivotal movement about a transverse axis by complementary part-cylindrical surfaces within the rear interior of the parts 11,29. The connector 24 provides for connection of the head to a wand or hose of a suction cleaner (not shown). The body 10 also carries wheels 28 to allow easy movement of the head across a floor surface.

The head also has a removable cover 18 which is shaped to co-operate with the first part 11 and the transverse member 13 of body 10 so as to contain the working parts of the head.

Thus the source of suction, in use, causes an airflow through the second opening 27, the turbine chamber 25 and the first opening 26, towards the source of suction.

A part 19 of the removable cover 18 positioned above the removable part 29, or possibly the entire cover 18, may be transparent or translucent, thus allowing a user to see the part 29 which may also be transparent, thus enabling sight of whether any foreign bodies are trapped within the turbine chamber 25.

Figure 4:
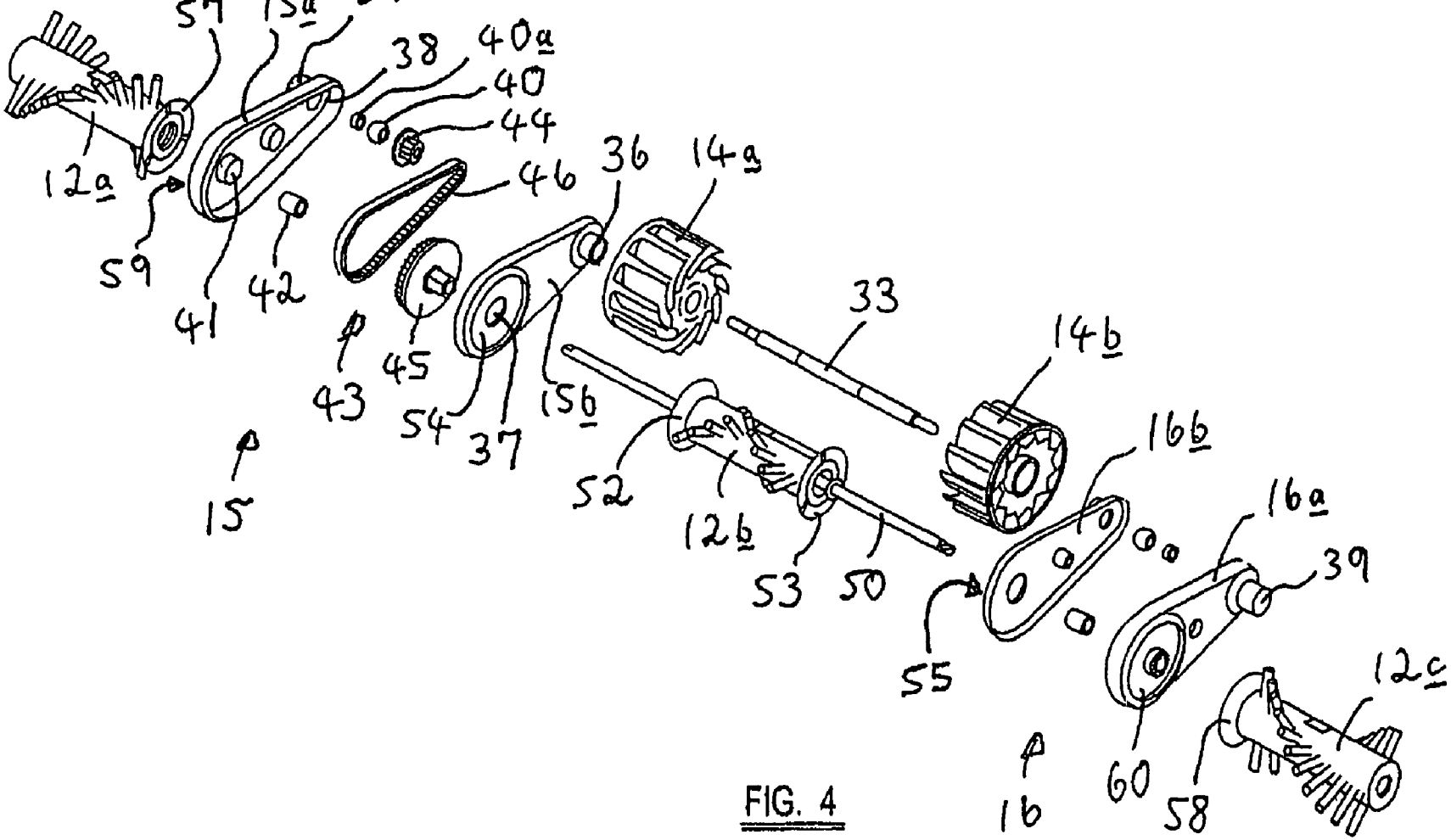
FIG. 4 is an exploded perspective view of a tool and support means in accordance with the present invention.

Turning now to FIG. 4 this shows an exploded perspective view of the tool 12, support members 15,16 and the turbine 14.

The turbine 14 includes two turbine parts 14*a,b* which are supported on an axle 33 for rotation therewith. The axle 33 extends through central bores of the turbine parts 14*a,b* and is of a length sufficient to protrude beyond outer radial faces of the turbine parts 14*a,b*.

Each support member 15,16 is connected at one end to a corresponding end of the axle 33 and at an opposite end to an axle 50, which axle 50 supports the tool 12. The support member 16 is a mirror image of the support member 15, with the exception that the support member 15 also contains the transmission means 43 for providing drive between the turbine 14 and the tool 12. Accordingly, only the support member 15 will be described.

The support member 15 has a pair of support parts 15*a,b*, which are connectable to each other by screw-threaded fasteners (not shown), by complementary engaging (eg. snap-fit) formations, or by any other suitable fastening means. The parts 15*a,b* are substantially teardrop shaped when the viewed along the axle 33 or the axle 50. The part 15*b* has at one end, which end is a narrower end of the teardrop shape, an aperture 36 to receive an end of the axle 33. At an opposite end of the part 15*b* there is a further aperture 37 to receive the axle 50.

The part 15*a* has, at a position opposite the aperture 36, a recess 38 which extends into a formation 39. The recess 38 is shaped so as to receive a bearing 40, which bearing 40 receives an end of the axle 33. The bearing 40 has a spherical exterior, to allow it to self-align to absorb any angular movement between the two support members 15,16. A lubrication pad 40<u>*a*</u> is provided within the formation 39, for lubricating the bearing 40.

The formation 39 is substantially cylindrical and extends away from the part 15*a*, substantially perpendicularly therefrom. The formation 39 on the part 15*a*, and the corresponding formation on the part 16*a*, are received in, and supported on, respective formations on the first part 11 of the body 10. This allows the support members 15,16 and the tool 12 to pivot relative to the body 10.

The assembly of parts 12, 14-16 may have a formation or formations which co-operate with the body 10 and/or the part 29 to ensure that the assembly can only be installed in the correct orientation relative to the body (i.e. not upside down which would leave the blades of the turbine 14 facing the wrong direction). For example the parts 15<u>*a*</u>,16<u>*a*</u> may each be moulded with a rib of which one is removed during factory assembly to enable the part 15<u>*a*</u> or 16<u>*a*</u> to be correctly fitted in relation to the body 10. However, the remaining rib on the other of the parts 15<u>*a*</u>,16<u>*a*</u> prevents the fitting of the support members 15,16 in the opposite positions.

The part 15*a* has an aperture 41, opposite the aperture 37, to receive a bearing 42, which bearing 42 receives and supports the axle 50.

Figure 5:
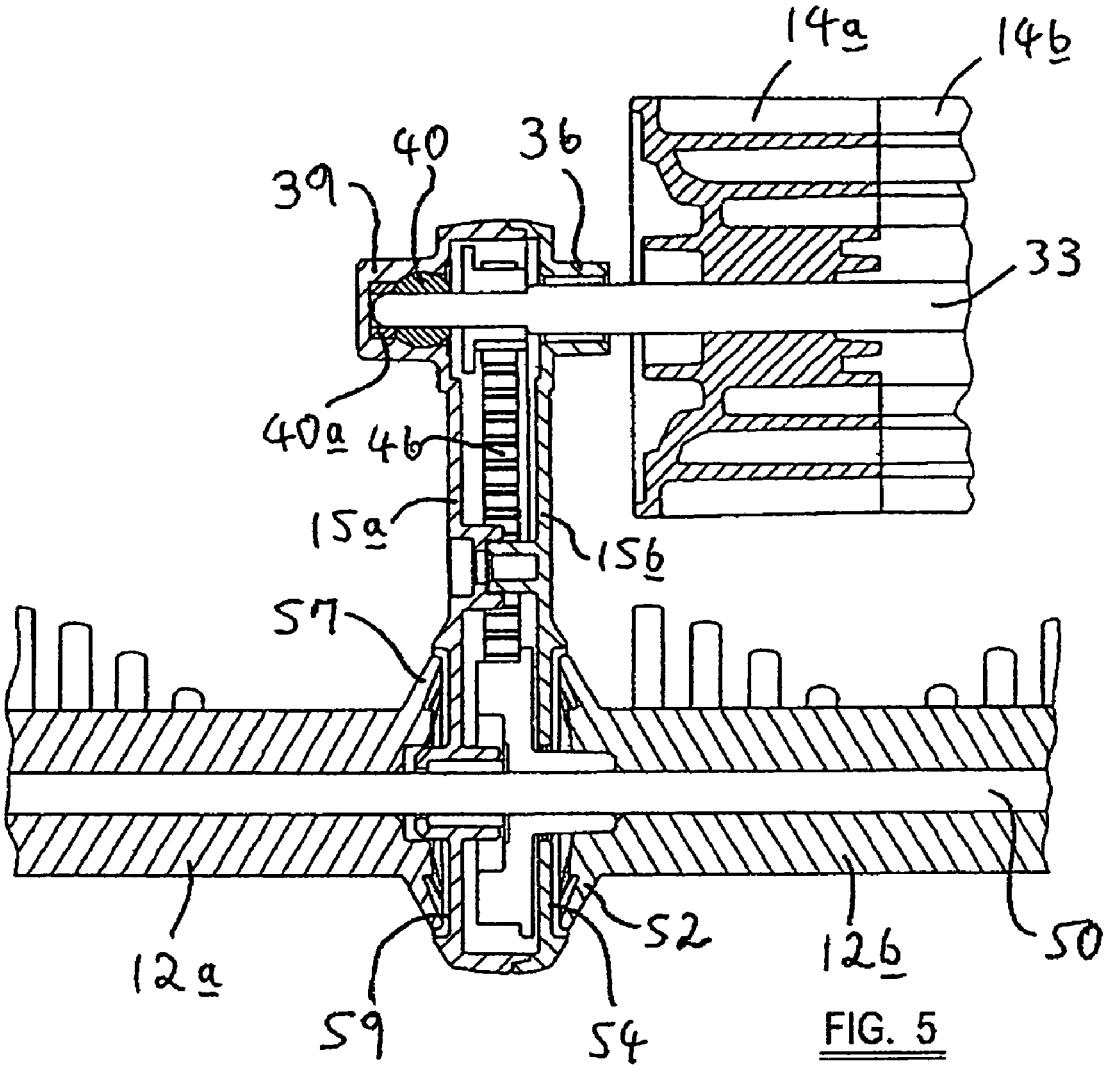
FIG. 5 is a cross-sectional plan view of a part of the support means shown in FIG. 4.

Contained within the support member 15 and shown in greater detail in FIG. 5 is the transmission means 43. The transmission means 43 includes a first toothed pulley 44 supported on the axle 33 for rotation therewith and a second toothed pulley 45 supported on the axle 50 for rotation therewith. The first and second toothed pulleys 44,45 are connected by a flexible driving element in the form of a toothed belt (46), which is entrained around the pulleys 44,45.

When the turbine 14 is caused to rotate by an airflow in a direction towards the source of suction, the axle 33 and the first pulley 44 also rotate. As the belt is engaged with the first and second toothed pulleys 44,45, rotation of the pulley 44 causes the second toothed pulley 45 to also rotate, which in turn effects rotation of the tool 12.

The tool 12 includes three substantially cylindrical parts; a central part 12*b* provided between the support parts 15*b*, 16*b* and two outer parts 12*a*,12*c*. The outer part 12*a* abuts an outer surface of the support part 15*a* and extends away therefrom and the outer part 12*c* abuts an outer surface of the support part 16*a* and extends away therefrom.

The parts 12*a,b,c* have respective apertures to receive the axle 50. The cross-section of the apertures and the axle 50 are shaped so as to prevent relative rotation therebetween, such as, for example, the axle 50 and the apertures in the parts 12*a,b,c* may be substantially D-shaped. However, the axle 50 may be an interference fit with the apertures of the parts 12*a,b,c*, thus obviating the need for a non-circular cross-section. The parts 12*a,b,c* are also removable from the axle 50 for service, maintenance or repair.

The central part 12*b* has at opposite ends thereof circular flanges 52,53. The flanges 52,53 engage in corresponding circular recesses 54,55 in the outer surfaces of the support parts 15*b*,16*b*, respectively.

The ends of the outermost tool parts 12*a*,12*c*, which ends abut the corresponding outer surfaces of the support parts 15*a*,16*a*, have respective circular flanges 57,58 which are received in corresponding circular recesses 59, 60 in the outer surfaces of the support parts 15*a*,16*a*, respectively.

The flanges 52,53,57,58 and their respective recesses 54,55,59,60 are provided so that any string, ribbon, long hair or the like are less likely to become entangled around the axle 50. There would have to be a substantial build-up of foreign objects around the parts 12*a,b,c* before any material could find its way into any gap between a circumferential edge of the flanges 52,53, 57,58 and an circumferential face of the recesses 54,55,59,60.

The parts 12*a,b,c* of the tool 12 are shown with bristles or brushes thereon. Other agitating means could be provided on the parts 12*a,b,c* of the tool 12 so as to engage a surface such as, for example, a carpet surface.

The head shown in FIGS. 1 to 5 is predominantly manufactured of a plastics material such as ABS, although the axles 33,50 are preferably metal. The belt is preferably of an elastomeric material with cord reinforcement. Also, even though the transmission means 43 as described above is in the form of first and second pulleys 44,45 and a belt entrained around the pulleys, other transmission means, such as meshed gears could also be used.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A cleaning head for a suction cleaner, the head including:

a body;

a support pivotally connected to the body;

a rotatable tool connected to the support;

a driver; and a transmission that drivingly connects the driver and the tool; wherein the support contains the transmission and wherein the tool is movable relative to the body and the support and the tool are pivotable with respect to the body, wherein the support is pivotally connected to the body, with the tool spaced from the pivoted connection so as to be arcuately movable relative to the body.

2. A cleaning head according to claim 1 wherein the driver is an electric motor.

3. A cleaning head for a suction cleaner, the head including:
a body;
a support pivotally connected to the body;
a rotatable tool connected to the support;
a driver; and
a transmission that drivingly connects the driver and the tool; wherein the support contains the transmission and wherein the tool is movable relative to the body and the support and the tool are pivotable with respect to the body, wherein the support includes two support members spaced from one another along the tool.

4. A cleaning head according to claim 3 wherein each support member is pivotally connected at one end to the body and connected at an opposite end to the tool.

5. A cleaning head according to claim 3 wherein the support members each support the tool at positions spaced from opposite ends of the tool.

6. A cleaning head for a suction cleaner, the head including:
a body;
a rotatable tool connected to the body by a support;
a driver; and
a transmission that drivingly connects the driver and the tool, wherein the support contains the transmission and wherein the tool is movable relative to the body wherein the transmission is provided in one of the support members, wherein the transmission includes a first gear driven by the driver and a second gear connected to the tool, the first and second gears being in driving connection with one another.

7. A cleaning head according to claim 6 wherein the transmission includes a flexible driving element, a first pulley driven by the driver and a second pulley connected to the tool, with the flexible driving element entrained around the first and second pulleys.

8. A cleaning head according to claim 7, wherein the pulleys are each supported within the support by a respective bearing.

9. A cleaning head for a suction cleaner, the head including:
a body;
a rotatable tool connected to the body by a support;
a driver; and
a transmission that drivingly connects the driver and the tool; wherein the support contains the transmission and wherein the tool is movable relative to the body, wherein the support includes two support members spaced from one another along the tool, and wherein the driver is positioned between the ends of the support members which are connected to the body.

10. A cleaning head for a suction cleaner, the head including:
a body;
a support pivotally connected to the body;
a rotatable tool connected to the support;
a driver; and
a transmission that drivingly connects the driver and the tool; wherein the support contains the transmission and wherein the tool is movable relative to the body and the support and the tool are pivotable with respect to the body, wherein the driver is a turbine.

11. A cleaning head for a suction cleaner, the head including:
a body;
a rotatable tool connected to the body by a support;
a driver; and
a transmission that drivingly connects the driver and the tool; wherein the support contains the transmission and wherein the tool is movable relative to the body, wherein the support includes two support members spaced from one another along the tool, wherein the driver is a turbine, and wherein an axis of rotation of the turbine and an axis about which the two support members are connected to the body are coaxial.

12. A cleaning head for a suction cleaner, the head including:
a body;
a rotatable tool connected to the body by a support;
a driver; and
a transmission that drivingly connects the driver and the tool; wherein the support contains the transmission and wherein the tool is movable relative to the body, wherein the support includes two support members spaced from one another along the tool, wherein the driver is an electric motor, and wherein an axis of rotation of the motor and an axis about which the two support members are connected to the body are coaxial.

* * * * *